US009333657B2

(12) United States Patent
Westerhof et al.

(10) Patent No.: US 9,333,657 B2
(45) Date of Patent: May 10, 2016

(54) SAFETY RAZOR APPARATUS HAVING A PIVOTABLE GRIP PORTION

(75) Inventors: Willem Auke Westerhof, Drachten (NL); Robert Alexander Van Eibergen Santhagens, Drachten (NL); Everhardus Johannes Hoexum, Drachten (NL); Ype Bernardus Brada, Drachten (NL); Roelof Steunenberg, Drachten (NL); Dirk Hendrik Wevers, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 775 days.

(21) Appl. No.: 10/587,341

(22) PCT Filed: Jan. 4, 2005

(86) PCT No.: PCT/IB2005/050015

§ 371 (c)(1),
(2), (4) Date: Jul. 25, 2006

(87) PCT Pub. No.: WO2005/072918

PCT Pub. Date: Aug. 11, 2005

(65) Prior Publication Data

US 2007/0151107 A1 Jul. 5, 2007

(30) Foreign Application Priority Data

Jan. 26, 2004 (EP) ..... 04100259

(51) Int. Cl.
*B26B 21/52* (2006.01)
*B26B 21/40* (2006.01)
*B26B 21/22* (2006.01)

(52) U.S. Cl.
CPC ..... *B26B 21/40* (2013.01); *B26B 21/225* (2013.01); *B26B 21/521* (2013.01)

(58) Field of Classification Search
CPC ..... B26B 21/22; B26B 21/225; B26B 21/40; B26B 21/4068; B26B 21/4075; B26B 21/443; B26B 21/52; B26B 21/521
USPC ..... 30/531, 131, 32, 34.05, 34.2, 51, 57, 30/77–79, 527–530, 532, 533, 50, 538
IPC ..... B26B 21/255, 21/22, 21/40, 21/4068, B26B 21/4075, 21/443, 21/52, 21/521
See application file for complete search history.

(56) References Cited

U.S. PATENT DOCUMENTS 1,010,704 A * 12/1911 Story ..... 30/72
1,052,039 A * 2/1913 Conklin ..... 30/51

(Continued)

FOREIGN PATENT DOCUMENTS

DE 29723518 U1 9/1998
GB 461542 A 2/1937
JP 2003535667 T 12/2003

OTHER PUBLICATIONS

"Decision of Technical Board of Appeal 3.3.1" March 18, 1993, T409/91, Official Journal EPO, vol. 1994, No. 9, pp. 653-664.

(Continued)

*Primary Examiner* — Clark F Dexter

(57) ABSTRACT

A safety razor apparatus having a blade assembly comprising two guiding members, each having a surface for abutting against the skin, and one or more blades located between the two guiding members (9,10), wherein the cutting edge of each blade and the surfaces are positioned substantially in one plane. The apparatus has a grip portion being pivotal relative to said blade assembly about a pivot axis, wherein the pivot axis is positioned parallel to the cutting edge. A location of the pivot axis is adjustable with respect to the blade assembly.

5 Claims, 2 Drawing Sheets

(56) References Cited

U.S. PATENT DOCUMENTS

Figure 1:
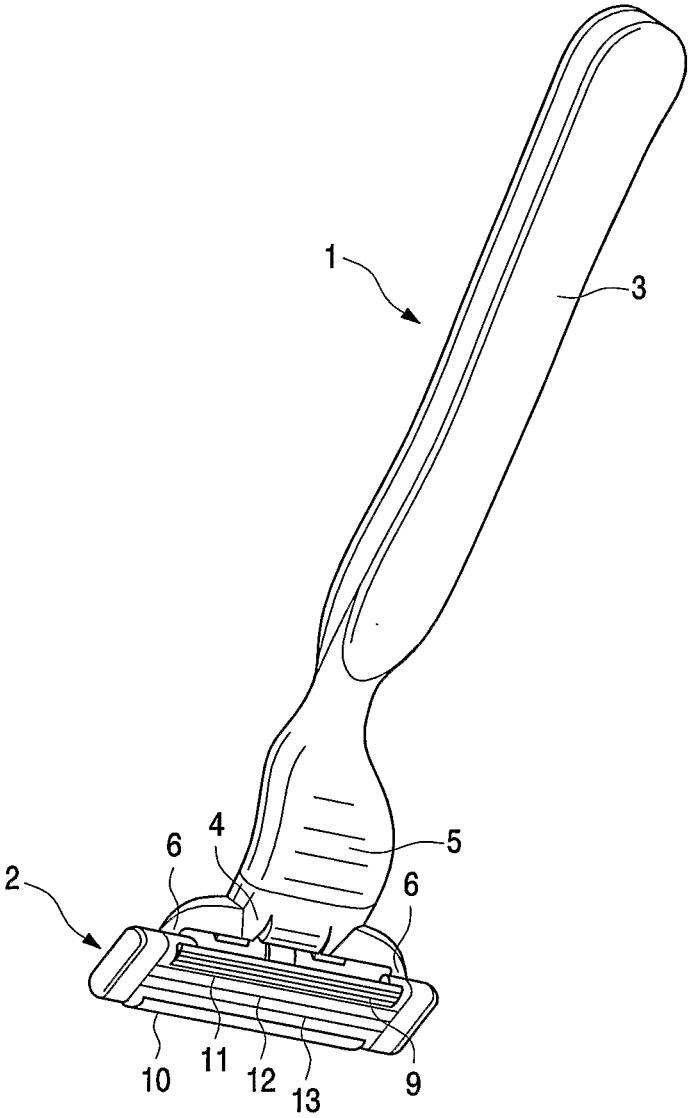

| | | | | | |
|---|---|---|---|---|---|
| 1,376,182 | A | | 4/1921 | Williams | |
| 1,670,309 | A | | 5/1928 | McAbee | |
| 1,694,337 | A | * | 12/1928 | Oberheim | 30/50 |
| 2,744,317 | A | * | 5/1956 | Borden | 30/40.2 |
| 3,950,848 | A | * | 4/1976 | Goldstein | 30/47 |
| 4,227,302 | A | | 10/1980 | Torrance | |
| 5,093,991 | A | * | 3/1992 | Hendrickson | 30/531 |
| 5,535,518 | A | * | 7/1996 | Althaus | 30/527 |
| 5,669,139 | A | | 9/1997 | Oldroyd et al. | |
| 5,787,593 | A | * | 8/1998 | Althaus | 30/527 |
| 6,115,924 | A | * | 9/2000 | Oldroyd | 30/527 |
| 6,161,288 | A | * | 12/2000 | Andrews | 30/50 |
| 6,557,265 | B2 | * | 5/2003 | Coffin | 30/532 |
| 6,671,961 | B1 | * | 1/2004 | Santhagens Van Eibergen et al. | 30/50 |
| 6,880,253 | B1 | | 4/2005 | Gyllerstrom | |
| 7,137,205 | B2 | * | 11/2006 | Royle | 30/527 |
| 2002/0088122 | A1 | * | 7/2002 | Zuidervaart | 30/50 |
| 2003/0066197 | A1 | | 4/2003 | Gilder | |
| 2003/0097755 | A1 | * | 5/2003 | Singh | 30/34.1 |
| 2003/0200660 | A1 | | 10/2003 | Pennella et al. | |
| 2005/0198843 | A1 | * | 9/2005 | Royle | 30/527 |

OTHER PUBLICATIONS

Decision of Technical Board of Appeal 3.3.1, March 9, 1994, T435/91, Official Journal EPO, vol. 1995, No. 4, pp. 188-201.

* cited by examiner

SAFETY RAZOR APPARATUS HAVING A PIVOTABLE GRIP PORTION

The invention relates to a safety razor apparatus having a blade assembly comprising two guiding members, each having a surface for abutting against the skin, and one or more blades located between said two guiding members, wherein the cutting edge of each blade and said surfaces are positioned substantially in one plane, and the apparatus having a grip portion being pivotal relative to said blade assembly about a pivot axis, wherein the pivot axis is positioned parallel to said cutting edge. In case of more than one blade, the respective cutting edges are positioned parallel to one another.

A safety razor apparatus of the kind mentioned in the opening paragraph is generally known. In case of more than one blade, the respective cutting edges are positioned parallel to one another. Preferably there are at least two blades. Furthermore, preferably the guiding member abutting against the skin in front of the blades is a skin stretching member. Between the skin and the surface of that skin stretching member there is a relatively high friction when the surface is pushed against the skin. Therefore, the skin is stretched in order to facilitate the shaving action of the blades. The guiding member abutting the skin behind the blades is preferably a lubrication member. The friction between the skin and the surface of that member is relatively low, and the lubrication member may contain a lubrication substance or the like.

Safety razors wherein the grip portion has a fixed position with respect to the blade assembly are well known. In said razors the position of the grip portion with respect to the blade assembly is chosen to satisfy the shaving requirements of the majority of the shaving persons, whereby an acceptable average shaving result is achieved for all facial regions to be shaved. However, this results in a non-optimal compromise for the individual person and for the different facial regions.

In order to overcome that problem, safety razors having a pivoting or hinging grip portion are developed, wherein the grip portion is pivotally connected to the blade assembly. By virtue thereof the blade assembly can follow the curved surface of the skin during the shaving operation, while the grip portion is moved at a certain angle relative to the skin by the hand of the shaving person. The pivot axis of the pivoting movement of the blade assembly has to be positioned substantially between the two guiding members to ensure a stable positioning of the blade assembly when it is pushed towards the skin by the grip portion.

In theory, it seems that the best location of the pivot axis with respect to the blade assembly can be calculated, whereby an optimal distribution of the pushing force over the two guiding members is achieved. However, in practice it has been found that such optimal positioning of the pivot axis often is not sensed as the best position by the shaving person. Often the shaving person puts his finger on the blade assembly to control the position of the blade assembly in a way he likes it, thereby expressing the feeling that the position is not satisfactory.

Furthermore, it has been found that different personal circumstances, such as the condition and the type of skin and beard, result in a different optimal location of the pivot axis with respect to the blade assembly.

An object of the invention is to provide a safety razor apparatus, by means of which the properties and the functioning of the apparatus can be adapted to the personal circumstances by the shaving person.

In order to achieve said object, a safety razor apparatus in accordance with the invention is characterized in that a location of said pivot axis is adjustable with respect to said blade assembly. Preferably, the pivot axis can be fixed in two or more positions with respect to the blade assembly. As a result, the effect of the force exerted by the grip portion on the blade assembly can be changed according to the personal preference and need of the shaving person. By adjusting the pivot axis the characteristics of the shaving system can be changed from precise but slightly aggressive, for which purpose the pivot axis is located near the first blade (the front blade), to skin friendly but less precise, for which purpose the pivot axis is located in front of the first blade, near the stretching member.

In one preferred embodiment the distance between said pivot axis and said one plane is less than 3 mm, preferably less than 1 mm. A small distance between the pivot axis and said plane ensures a stable position of the blade assembly when it is pushed against the skin, so that the location of the pivot axis can be varied without affecting the stability of the blade assembly, even in a case where the pivot axis is located near the stretching member.

Preferably, said pivot axis can be fixed at different locations in a plane parallel to said one plane. As a result, the distance between the skin and the pivot axis remains the same when changing the location of the pivot axis, so that said distance can be small at all locations of the pivot axis.

In order to achieve an adjustable pivoting or hinging connection between the grip portion and the blade assembly of the safety razor, many designs can be applied. However, in one preferred embodiment, the blade assembly can hinge around a pin, which pin is attached to said grip portion, wherein the blade assembly is provided with means for engaging said pin. Preferably, said means for engaging said pin comprise a number of recesses at different locations for accommodating said pin at such different locations.

In order to facilitate the fixation of the pin in a desired position, preferably, said means for engaging said pin comprise clamping means for holding said pin in a recess, with said clamping means enabling displacement of the pin from a recess to another recess when a predetermined force is being exerted. As a result, the location of the pivot axis can be easily changed by the shaving person without making use of any tool, even during the shaving operation.

In one preferred embodiment, said pin is positioned between a first engaging member provided with a number of recesses and a second engaging member having a surface facing said first engaging member, wherein said second engaging member pushes said pin towards said first engaging member, for example by spring means.

The invention also relates to a blade assembly for a safety razor apparatus as described above. Such a blade assembly comprises two guiding members, each having a surface for abutting against the skin, and one or more blades located between said two guiding members. The cutting edge of each blade and said surfaces are positioned substantially in one plane. The blade assembly comprises engaging means for pivotally connecting the blade assembly to the grip portion of the safety razor apparatus, wherein the pivot axis is positioned parallel to said cutting edge. Said engaging means comprise different locations for the pivot axis with respect to said blade assembly.

Figure 2:
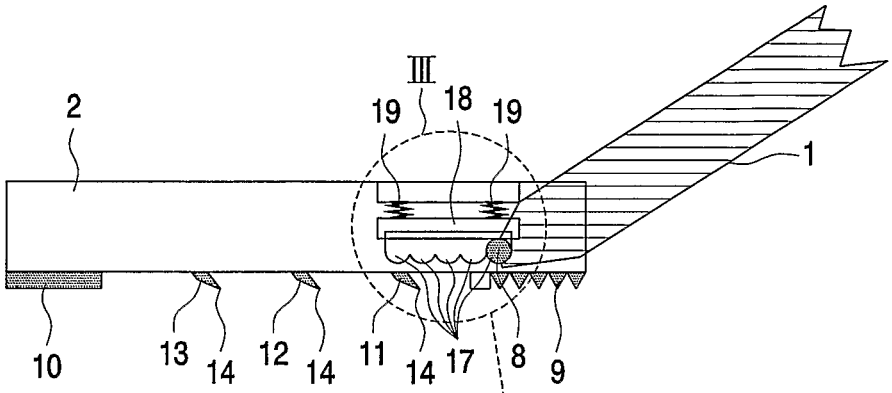
Figure 3:
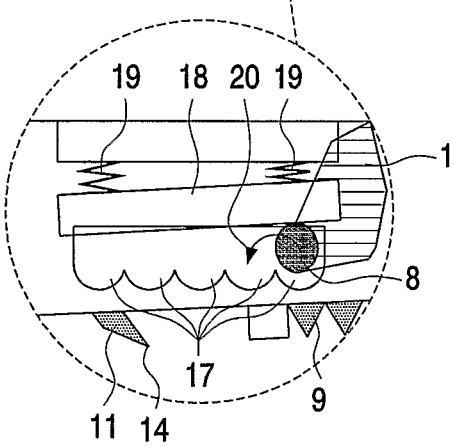

Embodiments of a safety razor apparatus according to the invention will be described in the following, reference being made to the drawing, in which:

FIG. 1 is a perspective view of a safety razor apparatus in accordance with the invention;

FIG. 2 schematically shows a connection between a grip portion and a blade assembly of the safety razor apparatus shown in FIG. 1; and FIG. 3 shows a portion of FIG. 2, indicated by the striped circle III in FIG. 2.

According to FIG. 1, the safety razor apparatus is provided with a grip portion 1 and a blade assembly 2. The grip portion 1 comprises a part 3 that can be held by the hand of a shaving person, and a part 4 provided with a hinging connection to the blade assembly 2. Between part 3 and part 4, the grip portion 1 comprises a broadened part 5 having a larger width than said part 3.

Part 4 of the grip portion 1 is provided with two arms 6. Between the ends of the arms 6 (not shown in FIG. 1) there is a pin 8 (see FIG. 2), forming the pivot axis for the blade assembly 2.

The blade assembly 2 is provided with a skin stretching member 9 and a lubrication member 10. Between the skin stretching member 9 and the lubrication member 10 there are three blades 11,12,13 having three parallel cutting edges 14 (see FIG. 2). The three blades 11 to 13 are mounted in a fixed position in the blade assembly 2 and the edges 14 are positioned substantially in a plane through the surface of the stretching member 9 and the surface of the lubrication member 10. During the shaving operation the skin is substantially located in that plane.

FIG. 2 schematically shows the hinging connection between the grip portion 1 and the blade assembly 2. The metal pin 8 is mounted at the end of the grip portion 1, and the blade assembly 2 can hinge around that metal pin 8. FIG. 2 shows a situation wherein the pin 8 is located near the stretching member 9, which location is at a relatively large distance in front of the cutting edge 14 of the first blade 11.

To enable the adjustment of the location of the pivot axis (pin 8) with respect to the blade assembly 2, the blade assembly according to this example is provided with a first engaging member having five parallel slots or recesses 17. The slots 17 are open grooves, all extending parallel to the cutting edges 14. Each of the slots 17 can accommodate the pin 8, and said pin 8 is pushed into one of the slots 17 by means of a second engaging member formed by pushing plate 18, which plate 18 is pressed downward by the spring elements 19, as is shown in FIG. 2. Pin 8 can be moved to another slot 17 by displacing plate 18 in upward direction, against the pushing force of spring elements 19. Such movement of the pin 8 is shown in FIG. 3, indicated by arrow 20.

As shown in FIG. 3, pin 8 can be moved from a position near the stretching member 9 to a position near the first cutting edge 14. As a result, the shaving behavior of the safety razor apparatus will change, so that the shaving person can adjust said behavior according to his preferences.

The invention claimed is:

1. A safety razor apparatus comprising:

a grip portion comprising:

a pin, said pin forming a pivot axis; and a blade assembly comprising:

two guiding members, each guiding member comprising a surface for abutting against a skin, one or more blades located between said two guiding members, wherein a cutting edge of each blade and said surfaces are positioned substantially in one plane, and means for engaging said pin, the means for engaging said in comprising a plurality of recesses, the recesses extending alongside one another and opening in the same direction, the pin being adjustable to different locations on the blade assembly by engaging a respective one of the plurality of recesses, said recesses positioned such that each recess extends parallel to said cutting edge of each blade, wherein said grip portion is pivotal relative to said blade assembly about said pin.

2. A safety razor apparatus as claimed in claim 1, wherein said means for engaging said pin comprises:

a clamping means for holding said pin in a corresponding one of said plurality of recesses.

3. A safety razor apparatus comprising:

a blade assembly comprising:

two guiding members, each having a surface for abutting against a skin, one or more blades located between said two guiding members, wherein a cutting edge of each blade and said surfaces are positioned substantially in one plane, and a plurality of recesses, each recess disposed at a different location and extending parallel to said cutting edge of each blade, said recesses extending alongside one another and opening in the same direction; and a grip portion including a pin, the grip portion pivotal relative to said blade assembly about the pin, wherein the pin engages one of said plurality of recesses.

4. A safety razor apparatus comprising:

a blade assembly comprising:

two guiding members, each comprising a surface for abutting against a skin, and one or more blades located between said two guiding members, wherein a cutting edge of each blade and said surfaces are positioned substantially in one plane; and a grip portion pivotal relative to said blade assembly about a pin attached to said grip portion, wherein the pin is positioned parallel to said cutting edge of each blade, the pin adjustable to different locations on the blade assembly, wherein the blade assembly can hinge around the pin, wherein the blade assembly further comprises:

clamping means for holding said pin in one of said plurality of different locations using a clamping force, the clamping means including a plurality of recesses, the recesses extending alongside one another and opening in the same direction, each recess extending parallel to said cutting edge of each blade and disposed at one of said different locations, and wherein the clamping means enables displacement of the pin from one of said plurality of recesses to another one of said plurality of recesses when a predetermined force is exerted on the pin.

5. A safety razor apparatus comprising:

a blade assembly comprising:

two guiding members, each having a surface for abutting against a skin, and one or more blades located between said two guiding members, wherein a cutting edge of each blade and said surfaces are positioned substantially in one plane; and a grip portion pivotal relative to said blade assembly about a pin attached to said grip portion, wherein the pin is positioned parallel to said cutting edge of each blade, the pin being adjustable to different locations on the blade assembly, wherein the blade assembly can hinge around the pin, wherein the blade assembly further comprises:

clamping means for holding said pin in one of said different locations, the clamping means comprising a first engaging member and a second engaging member biased towards the first engaging member, and wherein the pin is positioned between the first engaging member and the second engaging member at one of said different locations, the second engaging member having a surface facing said first engaging member, wherein said second engaging member pushes said pin towards said first engaging member.

* * * * *